United States Patent [19]

Moeglich

[11] 4,021,320

[45] May 3, 1977

[54] ELECTROCHEMICAL PROCESS UTILIZING ALTERNATING CURRENT FOR RECOVERY OF SILVER FROM PHOTOGRAPHIC FIXER SOLUTION AND OTHER SOLUTIONS CONTAINING SILVER IONS

[75] Inventor: Karl Moeglich, Williamsville, N.Y.

[73] Assignee: Silrec Systems, Inc., Williamsville, N.Y.

[22] Filed: Sept. 24, 1975

[21] Appl. No.: 616,402

Related U.S. Application Data

[63] Continuation of Ser. No. 550,454, Feb. 18, 1975, abandoned.

[52] U.S. Cl. ..... 204/96

[51] Int. Cl.[2] ..... C25B 1/00

[58] Field of Search ..... 204/96

[56] References Cited

UNITED STATES PATENTS

| | | | |
|---|---|---|---|
| 748,609 | 1/1904 | Hunt | 204/96 |
| 3,222,128 | 12/1965 | Sooryn | 204/96 |
| 3,733,256 | 5/1973 | Anderson | 204/109 |
| 3,793,168 | 2/1974 | Lilly | 204/109 |

*Primary Examiner*—R. L. Andrews
*Attorney, Agent, or Firm*—LeBlanc & Shur

[57] ABSTRACT

The present invention relates to a method of electrochemically removing silver in the form of AgO from a photographic fixer solution containing silver ions without destroying the utility of the solution comprising the steps of applying alternating current having a frequency of between about 0.5 Hz and 800 Hz and a current density of between about 0.1 and 20 amperes per square inch across electrodes immersed in said solution to cause AgO to precipitate at the electrodes. The method can also be practiced above the range of about 20 amperes per square inch at the cost of destroying the utility of the solution. The method can also be used to remove silver in the form of AgO from other solutions.

33 Claims, 3 Drawing Figures

ELECTROCHEMICAL PROCESS UTILIZING ALTERNATING CURRENT FOR RECOVERY OF SILVER FROM PHOTOGRAPHIC FIXER SOLUTION AND OTHER SOLUTIONS CONTAINING SILVER IONS

This is a continuation of application Ser. No. 550,454 filed Feb. 18, 1975, now abandoned.

The present invention relates to an improved method for recovering silver from used photographic fixer solutions and other solutions.

By way of background, in the fixing of photographic film, sodium thiosulfate or analogous agents are used to remove the unreduced silver from the film, and this silver concentrates in the fixing bath and is also carried over to the water which is subsequently used to wash the film. The recovering of silver from used photographic solutions is very desirable for a number of reasons. First of all, the recovered silver is not only economically profitable, but it is also essential to conserving a natural resource wherein roughly only about 65% of the silver which is used annually in industrial products is obtained from mining while the remainder must be obtained from other sources including the reclamation from industrial wastes. the photographic industry is estimated to consume approximately one-third of the total silver used by industry and therefore silver recovery from the wastes of the photographic industry comprises a significant means for conserving silver. It is estimated that the photo-finishing, X-ray and graphic art industries in the United States alone utilize about 2,000 tons of silver per year, and on the assumption that half of this amount remains on the photographic film or paper, then about 1,000 tons or 2,000,000 pounds of silver are dissolved by the processing solutions. A second extremely significant reason for recovering silver from photographic wastes is because silver is classified as a water pollutant and its salts have an extremely deleterious physiological effect. In this respect, the 1962 U.S. Public Health Service drinking water standards specify that silver is as toxic as hexavalent chromium, arsenic or lead and the concentration of any of these elements in excess of 0.05 parts per million results in causing water to be unsuitable for drinking purposes.

In the past, various processes were considered for use in reclaiming the silver from spent photographic fixing solutions. Certain of these processes were not practical from a commercial viewpoint. In this respect, certain processes were undesirable in that they destroyed the utility of the fixing solution, thereby preventing its reuse. Other processes destroyed the valuable pigments which could otherwise be reclaimed. Still other processes were only up to 90% efficient in recovering silver from the spent photographic fixing solution, thereby permitting an estimated 100 tons, or 200,000 pounds of silver to be dumped in the United States with its attendant economic loss and polluting effect, considering that water is polluted when it contains 0.05 parts per million of silver. Other processes were economically undesirable because of the initial cost of the equipment, or the cost of maintenance, or the cost of operation, or because of the fact that their productivity was not sufficiently high to warrant commercial usage.

Representative of the prior art methods of treating photographic fixing baths to reclaim silver are U.S. Pat. Nos. 1,954,316, 1,937,179, 3,642,594, 3,705,716 and 3,793,168. However, basically there are three methods for recovering silver from photographic processing solutions, namely, chemical precipitation, metallic replacement, and electrolytic treatment. The chemical precipitation method comprises the addition of a suitable chemical to a spent fixing solution to precipitate the silver which is removed by sedimentation or filtration. The most common way is to use sodium sulfide to cause silver to precipitate as silver sulfide. While this process is 100% efficient, economical and is a simple non-electrical system, there are certain disadvantages, namely: the settling times are very long and filtration is difficult which makes the process not particularly suited to large installations; the process is hazardous because of possible accidental acidification and liberation of hydrogen sulfide; and the thermal decomposition of the silver sulfide into silver produces sulfur-containing air pollutants.

The metallic replacement method operates by causing a metal such as iron, zinc, copper or aluminum to replace silver ions in solution which causes the silver to become solid metal, and steel wool is most often used. While this method has the advantages of utilizing inexpensive equipment and while it requires a simple non-electric installation, it has the disadvantages of removing only 95% of the silver under the most ideal conditions and generally removes less than 90%. This method consumes other raw materials during the course of recovery and may convert them to dangerous pollutants. In addition, it is concentration-dependent, the effective pH range is restricted between 4 and 6.5, and requires constant testing by an operator.

Various direct current electrolytic methods have been used to remove silver from photographic fixing solution. In one method two electrodes are placed in contact with the silver solution and silver sulfide is formed at the cathode. In addition, hydrogen sulfide and sulfur dioxide gases are generated. This method is not considered acceptable because of the generation of those gases and further because of the air pollution which is caused by the subsequent decomposition of the silver sulfide by heating. Another electrolytic method utilizes an open cell having electrodes placed within the electrolyte and metallic silver is plated at the revolving cathode with a purity of about 90%. This process is undesirable because the current must be carefully controlled to prevent the formation of silver sulfide, hydrogen sulfide and sulfur dioxide. In addition, the electrolyte must be agitated to furnish a continuous supply of silver ions to the cathode, and the cell current has to be regulated in proportion to the silver content. Furthermore, the plating equipment is expensive, the recovery efficiency is not greater than 85% and this process does not work on all types of fixers, such as bleach-fixer baths.

By way of further background, in the metallic replacement process noted above, the bulk of silver is recovered from the fixing solution. However, the typical discharge of spend fixer after treatment contains about 10% of the original silver in solution. As noted above, 0.05 parts per million is the amount of silver which will cause rejection of water for drinking purposes. In addition, the fixed photographic film carries with it, from the fixing tank to the washing tank, a measurable amount of silver when the silver content of the fixer bath is high. This wash water adds to the amount of silver which is dumped with the treated fixer. In addition, the metallic replacement process is an overflow system, that is, once the used fixer has been treated, it must be discarded because the treatment destroys the chemistry of the solution.

In contrast to the foregoing, the method of the present invention is a recirculating system which keeps the silver content in the fixer bath at a minimum acceptable and uniform level, which also results in less silver being carried into the wash water by the film being processed, so that less process water may be required for washing. In addition to the higher percentage of silver recovered in a recirculation system, the utility of the fixer solution is not destroyed so that it may be reused.

Of the currently used silver recovery processes, as described briefly above, only the electrolytic plating process, to a limited extent, is useful in the processing of fixer solutions to permit recirculation. The metallic replacement process, noted above, releases iron into the fixer and renders the solution useless for most photographic purposes, but it is a practical method for the recovery of pigments from bleach fixing baths. The electrolytic plating method, mentioned briefly above, may produce some detrimental chemical decomposition. However, when properly monitored, this method is the only one presently suitable for silver removal with recirculation. However, this process is restricted to use with sodium thiosulfate and cannot be used with ammonium thiosulfate fixers or with bleach-fix baths.

It is accordingly an important object of the present invention to provide an improved method for reclaiming silver from used photographic fixing solution and other solutions containing silver which can be used to remove any desired amount of silver from solution up to 100%, depending on the amount of treatment, thereby not only conserving silver for reuse, but also lessening silver water pollution.

Another object of the present invention is to provide an improved practical process for removing silver from used photographic fixing solution without changing the pH or the utility of the solution, thereby permitting both its reuse and the reclaimation of the expensive pigments therein.

A further object of the present invention is to provide an improved process for removing silver from a used photographic fixing solution and other solutions containing silver which is extremely simple, economical to operate, efficient, and which may be used in conjunction with different sizes of photographic installations with equal facility. A related object of the present invention is to provide an improved method of recovering silver from used photographic fixer solutions and other solutions containing silver in which the cost of recovering the silver is a very small percentage of the value of the recovered silver.

Yet another object of the present invention is to provide an improved process for reclaiming silver from used photographic fixing solution wherein the silver is reclaimed in the form of argentic oxide which can be used in certain applications in the form in which it is reclaimed or which can be reduced to pure metallic silver by heating without polluting the atmosphere.

Still another object of the present invention is to provide a novel process for producing argentic oxide from silver salt solutions. Other objects and attendant advantages of the present invention will readily be perceived hereafter.

The improved method of the present invention is directed to the electrochemical removal of silver in the form of argentic oxide from a photographic fixer solution without destroying the utility of the solution and comprises the steps of applying alternating current having a frequency of between about 0.5 Hz and 800 Hz and a current density of between about 0.1 and 20 amperes per square inch across the electrodes immersed in said solution to cause argentic oxide to precipitate at the electrodes.

The improved method of the present invention is also directed to the removal of silver in the form of argentic oxide from a photographic fixer solution comprising the steps of placing electrodes into electrical contact with said solution and applying an alternating current having a frequency of between about 0.5 Hz and 800 Hz to said solution.

The present invention is also directed to the converting of a silver salt to argentic oxide comprising the steps of dissolving the silver salt in a solution of sodium, potassium, or ammonium thiosulfate, placing electrodes in electrical contact with the solution, and applying alternating current of a frequency of between about 0.5 Hz and 800 Hz across the electrodes to cause argentic oxide to precipitate at the electrodes.

The various aspects of the present invention will be more fully understood when the following portions of the specification are read in conjunction with the accompanying drawings wherein.

Figure 1:
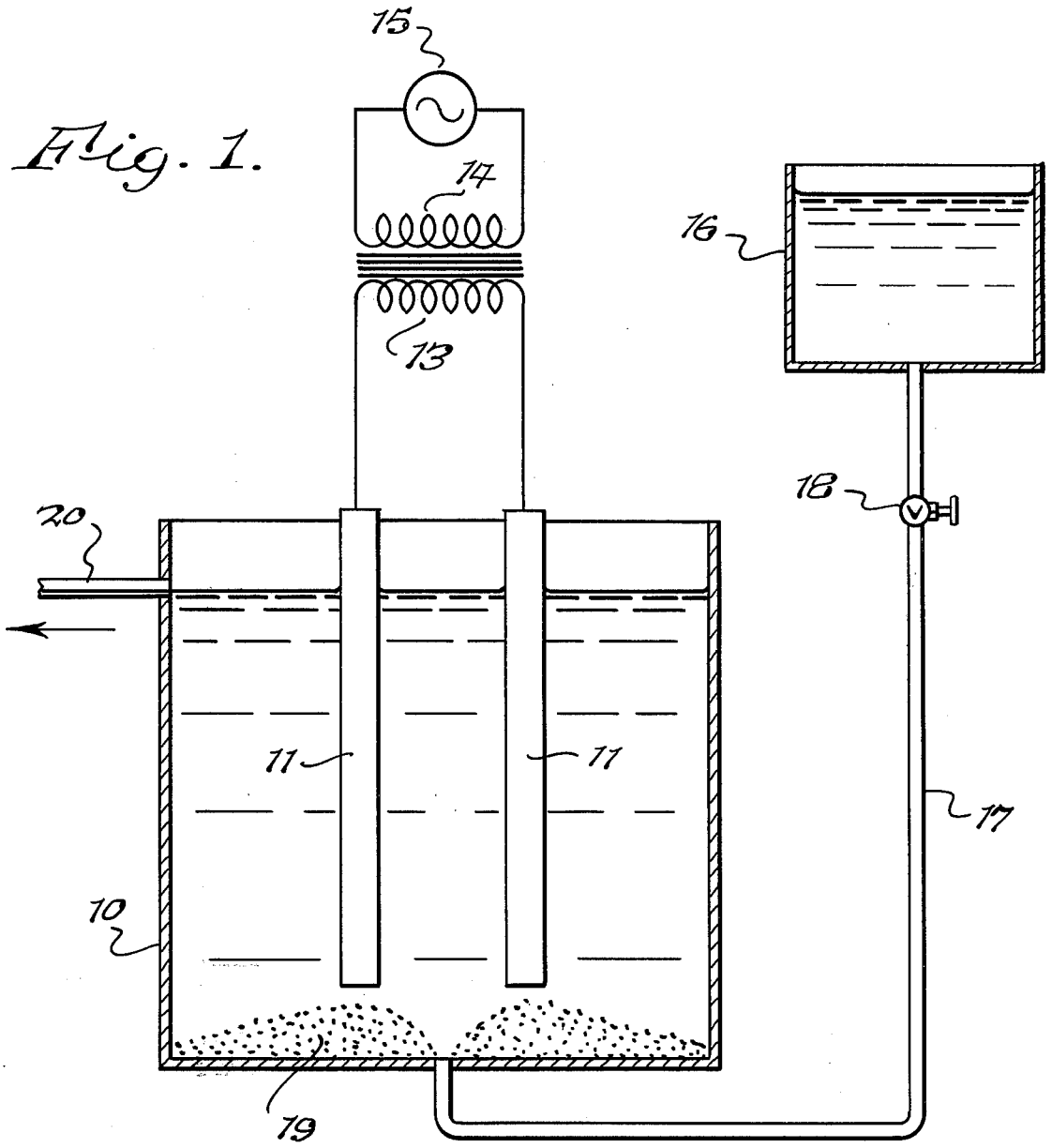
FIG. 1 is a schematic representation of apparatus for performing the present process.
Figure 2:
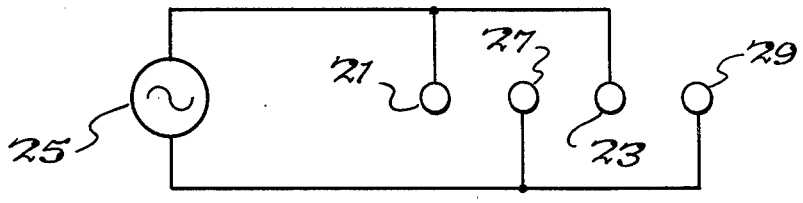
FIG. 2 is a schematic wiring diagram for the electrodes in Example II.

The cell 10 of FIG. 1 has two graphite rods 11 immersed therein. These rods, which function as electrodes, are connected to a transformer secondary 13, which is energized by the primary 14 which is connected across a suitable alternating current source 15. Photographic fixer solution is supplied from tank 16 to the bottom of cell 10 through conduit 17 having valve 18 therein to regulate flow. The outflow from cell 10 is through conduit 20 back to photographic fixer tank 16 where it is reused. Electrodes 11 are preferably fabricated from graphite, and are preferably cylindrical. Graphite rods of electrode grade manufactured under the trademark ARCAIR by Union Carbide Company have been used successfully. It will be appreciated that any desired number of pairs of electrodes may be used, and that generally more electrodes will permit faster separation of silver from solution. Where more than two electrodes are used, they can be connected as shown in FIG. 2, wherein electrodes 21 and 23 are connected to one side of AC source 25 and electrodes 27 and 29 are connected to the other side. As will be explained in greater detail hereafter, argentic oxide (AgO) is formed at electrodes 11 and subsequently precipitates as a deposit 19.

Figure 3:
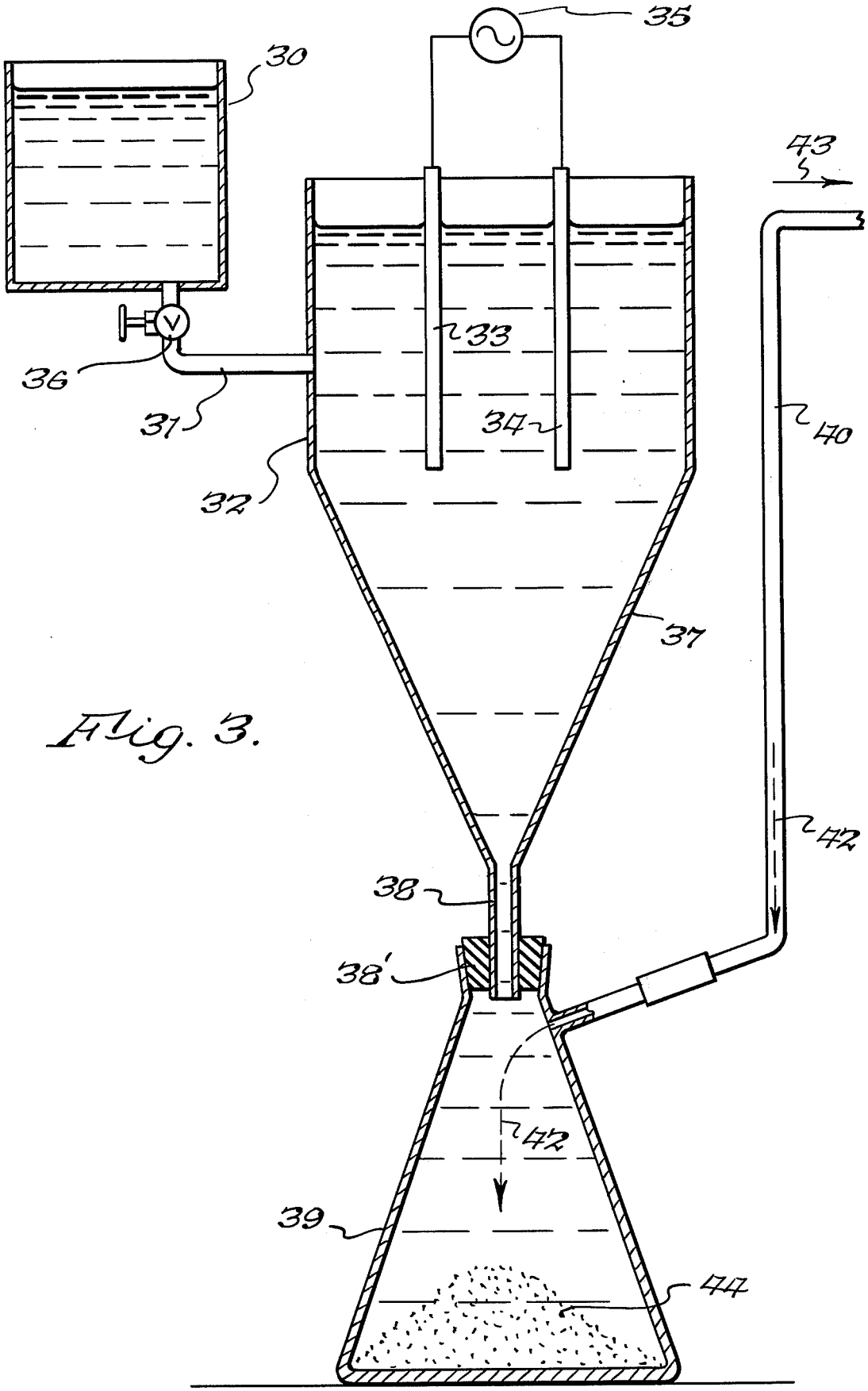
FIG. 3 is a schematic representation of the apparatus described in Example III.

In FIG. 3 a further embodiment of the present invention is shown. In this embodiment, a tank 30 contains photographic fixer solution and this solution is passed through conduit 31 to cell 32 having graphite electrodes 33 and 34 therein which are connected across a suitable alternating current source 35 which may be a generator, or the secondary of a transformer. A valve 36 in conduit 31 regulates the flow to cell 32. Cell 32 includes an inclined wall 37 which may be in the form of an inverted frustoconical funnel, with the angle of inclination of wall 37 being such that the precipitating argenic oxide cannot rest on it but must pass through cylindrical portion 38 into flask 39. Rubber stopper 38' receives portion 38 and provides a seal between it and flask 39. Because of the flow through conduit 31, the liquid from flask 39 will flow upwardly through conduit 40. The fine silver oxide which is carried upwardly through conduit 40 with the electrolyte will tend to settle in the direction of dotted arrows 42 back into flask 39 to ultimately form a deposit 44 while the clear solution without silver oxide therein will pass from conduit 40 in the direction of arrow 43 back to fixer tank 30 or elsewhere where it may be reused.

The current density across the electrodes is within the range of between about 0.1 amperes per square inch to 20 amperes per square inch when it is desired to reuse the photographic fixer. Actually there is no upper limit for the current density other than the higher current flows, generally above 20 amperes per square inch, will heat the photographic fixer or electrolyte beyond the upper desired temperature and therefore cause decomposition of the electrolyte, which is undesirable in a system where the electrolyte is to be reused. In this connection, it is understood that by utilizing cooling methods the temperature may be maintained within desired limits while using higher current densities. However, where it is not desired to reuse the fixer, the higher current densities, above about 20 amperes per square inch, will produce faster formation of AgO at the expense of higher power consumption and at the expense of destroying the utility of the fixer solution. the lower limit of current density produces AgO formation when the solution being treated is of sufficiently high concentration, that is, a saturated solution will give AgO formation at about 0.1 amperes/in$^2$. The preferred range of current density is between 1 and 10 amperes per square inch, and it is especially preferred that the current density be maintained between about 3 and 7.5 amperes per square inch.

The present process will operate at an electrolyte temperature of between freezing and boiling. However, the preferred temperature range is between freezing and 60° C., and the past preferred range is between 20° C. and 45° C. Starting at about 60° C., in ammonium-containing fixers, ammonia begins to be liberated with the amounts increasing as boiling is approached. However, the utility of the fixer progressively lessens as the temperature progressively increases about 60° C., and as the boiling point is approached, decomposition of the sulfur compounds takes place.

There is no extra pH adjustment needed for photographic fixers, prior to or during the treatment.

Any fixer with any silver content can be treated by the apparatus and method depicted and described and as noted above, and as determined by actual tests, there is no destruction of the utility of the solution because the pH is not changed by the treatment, no sulfur is removed in the form of a precipitate or silver sulfide, and there is no destruction of any of the pigments or components contained in the solution which thus permits the solution to be reused. The fixers which can be treated, by way of example, are sodium, potassium, and ammonium thiosulfate, or combinations thereof, and the pigment-containing bleaches as used in color development. Thus the operation of the process is in no way dependent on the concentration of the silver in the fixer. The used fixer will also contain bromide ions. In addition, any concentration of other silver-ion containing solutions, such as chlorides, nitrates, sulfates and phosphates, can be treated by a modified form of the method of the present invention to precipitate AgO, and all parameters such as current density, frequency and material of electrodes, are the same for this modified form of the invention as discussed in detail for obtaining AgO from photographic fixer. If it is desired to preserve the utility of the solution for extraction of the salt, the current density range should be maintained between about 0.1 and 20 amperes per square inch at the electrodes.

The present process can be operated as a batch process or a flow process. If operated as a flow process, there is no minimum of maximum specific flow rate required other than that which would maintain the silver depletion or operating temperature within the desired limits.

It is believed that the argentic oxide is formed under caustic conditions which are created on the electrode interfaces. In this respect, during the negative half cycle a caustic layer is formed on the surface of the negatively charged electrode. This can be potassium hydroxide, ammonium hydroxide, or sodium hydroxide, depending on whether the solution contains potassium ions, ammonium ions, or sodium ions, respectively. Also present within this caustic interfacial layer are the silver ions, and the sulfur radicals as negative ions are repulsed. During the following positive cycle, the hydroxyl ions (OH−) which have a higher rate of mobility than the negatively charged $S_2O_3^{--}$ ions, which are in solution because the fixer is a thiosulfate, enter the existing caustic atmosphere and react with the silver ions. The reaction compound is argentic oxide (AgO) since silver hydroxide does not exist. The exact mechanism of argentic oxide formation is not known. It could be direct oxidation of the silver ions to the oxide or a formation of the hydroxide followed by loss of hydrogens. The equivalent free hydrogen can be observed as a reaction by-product. The reaction and silver oxide formation occurs on both electrodes as the current goes alternately through both the negative and positive half cycles.

In recovering argentic oxide from other silver solutions containing ions such as nitrates, sulfates, chlorides or phosphates, the same basic underlying theory operates, as explained in detail above relative to fixer solutions, to precipitate AgO at the electrodes.

Generally, therefore, in order to remove silver ions as AgO from any solution within the scope of the present invention, there must be present ions such as sodium, potassium or ammonium which will produce a caustic interface, and also $S_2O_3^{--}$ as anions. Generally, the foregoing conditions can be realized by adding sodium, potassium or ammonium thiosulfate to the silver solution from which AgO is to be precipitated electrochemically.

The process operates at a frequency of between about 0.5 Hz and 800 Hz. At 0.5 Hz, that is, a half-cycle duration of one second, some silver sulfide is formed with the AgO. This is understandable because the frequency of 0.5 Hz is characteristically close to direct current which is known to result in the formation of silver sulfide only. Above 800 Hz only a minor polarization occurs and at 1000 Hz there is complete depolarization and consequent termination of the electrochemical reaction. Thus the operable frequency range is between about 0.5 Hz and 800 Hz; a practical and economical operable range is between about 10 Hz and 120 Hz; and for technical and practical reasons it is preferred to conduct the process at a frequency of about 60 Hz.

As noted above, graphite electrodes are preferred and these should preferably be cylindrical and either ¼ inch or ⅜ inch in diameter, although other shapes can be used. However, the electrode material can be made from the noble metals; ruthenium oxide on valve metals, such as tantalum, columbium and titanium; or stainless steel alloys such as 304.

The process of the present invention is extremely economical in that there is a very small capital outlay for equipment, very low maintenance, no moving parts, and very low electricity costs. In the latter respect, test results have shown that several Troy ounces of silver can be recovered for each kilowatt of electricity.

In the following examples the concentration of silver is expressed as cubic centimeters of $Ag_2S$ per 10 cubic centimeters of solution. This value is obtained by centrifuging 10 cubic centimeters of fixer with ammonium sulfide as a reagent and measuring the volume of the precipitate.

In the following examples the current density is obtained by dividing the total current by a predetermined portion of the surface area of one of two equal electrodes, this predetermined surface area being that portion of one of the electrodes which faces the other electrode. For example, where the electrodes are cylindrical, the effective surface area is one-half of each immersed cylindrical surface of one of two equal cylindrical electrodes. Where the electrodes are rectangular, the predetermined surface area is that portion of each electrode which faces the other.

EXAMPLE I

A cell of the type shown in FIG. 1 of 1 liter capacity was used. The electrolyte or fixer was a combination of spent sodium and ammonium thiosulfate. Two cylindrical graphite rods ¼ inch in diameter were each immersed to a depth of 3.5 inches. Thus the effective electrode area was 1.37 square inches. The electrolyte was slightly agitated by air injection to effect circulation of the electrolyte. The applied current was 10 amperes AC at a voltage of 6.6 – 7.6 volts and at a frequency of 60 Hz. The current density was 7.3 amperes per square inch. In a batch type of operation, the following test results were obtained:

| Elapsed time in hours | 0 | 1 | 1.5 | 2 | 2.75 |
|---|---|---|---|---|---|
| Silver content in cc of $Ag_2S$ per 10 cc of solution | 1.2 | 0.6 | 0.5 | 0.4 | 0.15 |

The above results show that in 2¾ hours the silver level fell from 1.2 to 0.15 cc of $Ag_2S$ per 10 cc of solution. During the above tests the maximum temperature of the electrolyte was 61° C. The pH remained unchanged at 4. Argentic oxide (AgO) precipitated at both electrodes. No elemental sulfur was formed. No sulfur dioxide was generated. A small amount of ammonium hydroxide was formed, but not enough to effect the pH measurement.

EXAMPLE II

A 4 liter tank was used with 4 graphite electrodes wired in pairs in parallel as shown in FIG. 2. A current of 15 amperes AC at 60 Hz was applied across the electrodes in two separate tests. In Test I, cylindrical electrodes ¼ inch in diameter were used with 5 inches immersed to provide a current density of 2.55 amperes/square inch. In Test II cylindrical electrodes ⅜ inch in diameter were used with 4½ inches immersed to provide a current density of 1.9 amperes/square inch. The electrolyte was spent combined sodium and ammonium thiosulfate. Both tests ran at about 60° C. Both tests consisted of batch runs. AgO was precipitated at all electrodes. Silver concentration of the remaining solution is listed as cubic centimeters of $Ag_2S$ per 10 cc of solution.

| Elapsed time in hours | 0 | 2 | 4 | 6 | 8 | 10 | 12 |
|---|---|---|---|---|---|---|---|
| Silver content in cc of $Ag_2S$ per 10 cc of solution | | | | | | | |
| Test I | 1.1 | | 0.46 | 0.35 | | 0.13 | 0.06 |
| Test II | 1.1 | 0.89 | 0.7 | 0.35 | 0.14 | 0.075 | 0.05 |

From the above it can be seen that a high current density is more efficient for high concentrations of silver, but both current densities eventually reach virtually the same low concentration.

EXAMPLE III

This test was run under flow conditions to remove Ag from 2 gallons of spent combined sodium and ammonium thiosulfate fixer, which was recirculated through the cell five times. The cell arrangement included a raised outflow tube and settling tank so that treated fixer without AgO particles is recovered, as shown in FIG. 3. The silver level in the outflow is expressed as cubic centimeters of $Ag_2S$ per 10 cc of solution. The current density was 7.3 Amp/in$^2$. Temperature equilibrated between 55°–60° C. No ammonia was detected. Two graphite electrodes of ¼ inches in diameter were used, and the AC frequency was 60 Hz. AgO precipitated at both electrodes. The following table shows the amount of silver removed for each pass of the solution through the cell.

| Pass | 0 | 1 | 2 | 3 | 4 | 5 |
|---|---|---|---|---|---|---|
| Flow cm$^3$/hr. | — | 820 | 1010 | 1010 | 1050 | 1080 |
| Time in hours for pass to be completed | | 9.25 | 7.5 | 7.5 | 7.2 | 7.0 |
| pH | 4 | 4 | 4 | 4 | 4 | 4 |

-continued

| Pass | 0 | 1 | 2 | 3 | 4 | 5 |
|---|---|---|---|---|---|---|
| Silver content in cc of $Ag_2S$ per 10 cc of solution | 1.2 | 0.9 | 0.75 | 0.6 | 0.3 | 0.1 |

EXAMPLE IV

In a cell containing 900 cc of spent ammonium and sodium thiosulfate, two graphite rods, ¼ inch in diameter were each masked except for 1 inch of length. At a total of 7.85 amperes across the electrodes, this corresponds to a current density of 20 amperes/in². Maximum temperature reached was 67° C. and the pH remained at 4 throughout the test. The frequency was 60 Hz. Ammonia was liberated. AgO precipiated at both electrodes.

| Elapsed time in hours | 0 | 1 | 2 | 3 |
|---|---|---|---|---|
| Silver content in cc of $Ag_2S$ per 10 cc of solution | 0.16 | 0.10 | 0.05 | 0.03 |

EXAMPLE V

The same fixer as set forth in Example IV and having an original concentration of 0.16 cc of $Ag_2S$ per 10 cc of solution was used, and 180 cc of this fixer was subjected to a current density of 22 amperes/in² for one hour with the same electrode arrangement as Example IV to create a boiling condition to see if removal continues at those extreme conditions. The frequency was 60 Hz. Excessive gas evolution was observed and the rate of the reaction was lessened. Half of the water was boiled off and was replaced. The silver content was then 0.02 cc $Ag_2S$ per 10 cc of solution. Appreciable decomposition of the fixer was noticed accompanied by sulfur precipitation and the pH rose close to 5. The actual efficiency of this run is about 50% of Example IV. Ammonia was liberated and gaseous sulfur decomposition products were noticed. The silver concentration in solution was thus reduced from 0.16 to 0.02 cc of $Ag_2S$ per 10 cc of solution in one hour at the cost of efficiency.

EXAMPLE VI

A set of ¼ inch diameter graphite electrodes were inserted in 200 cc of a mixture of sodium and ammonium thiosulfate fixer having an initial concentration of 0.16 cc of $Ag_2S$ per 10 cc of solution. A current density of 0.1 amperes/in² was applied for 5 hours at a frequency of 60 Hz. A very small amount of AgO formation was observed. The current density was raised to 0.3 amperes/in² for 19 hours. More silver oxide formation was noticed and it could be mechanically tapped off of the electrodes. It was observed that when the current density was raised to 0.5 amperes/in², it took about 72 hours for the oxide to flake off the electrodes. During the tests the temperature remained at about 20° C. No ammonia was liberated.

EXAMPLES VII AND VIII

Two 990 cc samples of a mixture of sodium and ammonium thiosulfate, each initially having a concentration of 0.16 cc $Ag_2S$ per 10 cc of solution were treated with 15 amperes/in² for 1 hour. Each reached a temperature of 55°–56° C. No ammonia was liberated. After one hour, each had an Ag level of 0.04 cc of $Ag_2S$. One sample was run at a frequency of 0.5 Hz and the other at 2.25 Hz. Graphite electrodes of ¼ inch in diameter were used with 1 inch depth not masked giving a total current of 6 amperes. The 0.5 Hz treated sample was a clear liquor which had a 65% light transmittance at a wave length of 475 mμ while the percent light transmittance of the 2.25 Hz treated sample was 85%. Since the initial percent light transmittance of the solution was 81%, there was apparently some decomposition in the 0.5 Hz sample. All samples measured pH 4. The samples showed the presence of an increased amount of AgO with increased frequency. The percent light transmittance of the amount of light at the specified frequency passing through the solution is against the amount of light passing through distilled water considered as 100%.

COMMON PARAMETERS FOR EXAMPLES IX–XII

All tests set forth in Examples IX–XII were conducted at 60 Hz and the initial Ag level was 0.4 cc of $Ag_2S$ per 10 cc of solution. The fixer was a mixture of sodium and ammonium thiosulfate.

EXAMPLE IX

Platinum electrodes were used. There was a slow formation of AgO at both electrodes at 0.1 amperes/in².

EXAMPLE X

The electrodes were 14 mesh 314 stainless steel. AgO formed slowly at both electrodes at 0.1 amperes/in² but formed immediately at 0.6 amperes/in².

EXAMPLE XI

Stainless steel plate was used. AgO formed within 5 minutes at 0.5 amperes/in². Gas formed at 2 amperes/in² and argentic oxide starts to flake off the electrodes at 7 amperes/in².

EXAMPLE XII $RuO_2$ coated Ti, normally used as anodes in chlor-alkali cells, was used. They are a mesh, with about 50% open space. Silver oxide forms readily at 2 amperes/in².

COMMON PARAMETERS FOR EXAMPLES XIII–XVI

To duplicate the effect of different silver salts being dissolved in a solution of sodium or ammonium thiosulfate, different sodium salts were added to silver-containing fixer. In this respect, in the following examples sodium chloride, sodium nitrate, sodium sulfate, or sodium phosphate was added to a used fixer solution consisting of a combination of sodium and ammonium thiosulfate containing silver ions and bromide ions. The amount of the sodium chloride, nitrate, sulfate or phosphate was stoichiometrically calculated corresponding to the amount of silver present in the solution. Thus the resulting combined solution contained sodium and ammonium ions from the fixer, silver ions from the silver originally dissolved in the fixer, thiosulfate ions, bromine ions, sodium ions from the salt which was dissolved in the fixer, and either chloride ions, nitrate ions, phosphate ions, or sulfate ions, depending on the salt which was dissolved. In each of the following examples the fixer silver level was 0.4 cc of $Ag_2S$ per 10 cc of solution which was approximately equivalent to 4 grams of silver ions per liter. A sample containing 400 cc of solution was subjected to one hour of treatment by applying 4 amperes of current across two ¼ inch cylindrical graphite rods immersed to a depth of 1 inch to provide a current density of approximately 10.2 amperes per square inch. The frequency was 60 Hz. The following test results were obtained for each of the examples indicated.

| | Anion | Final temperature of solution (° C.) | Final $Ag^+$ ($cm^3$ $Ag_2S$) |
|---|---|---|---|
| Control | — | 49 | 0.25 |
| Example XIII | $Cl^-$ | 51 | 0.30 |
| Example XIV | $NO_3^-$ | 51.5 | 0.30 |
| Example XV | $SO_4^=$ | 51 | 0.30 |
| Example XVI | $PO_4^{\equiv}$ | 51.5 | 0.20 |

pH of all samples before and after is 4.

Since the original silver level of the fixer before each of the salts were added was 0.4 cc AgS per 10 cc of solution and since the final silver concentration in each instance, as set forth for each example, was less than 0.4 cc Ags per 10 cc of solution after treatment, it can be seen that there was a decrease in the silver concentration due to the precipitation of AgO at the electrodes. In addition, the pH of all examples, both before and after the above described treatment, remained at 4, thereby indicating that the utility of the original solution was not changed.

COMMON PARAMETERS FOR EXAMPLES XVII–XX

In examplesXVII–XX the applied voltage was between 2.8 volts and 4.5 volts and the temperature of the solution did not exceed 35° C. The electrodes were two ¼ inch diameter graphite rods. The fixer solution was a combination of sodium and ammonium thiosulfate. The concentration of silver is expressed in cc of $Ag_2S$ per 10 cc of solution.

| | EXAMPLE XVII | EXAMPLE XVIII | EXAMPLE XIX | EXAMPLE XX |
|---|---|---|---|---|
| Frequency (Hz) | 60 | 120 | 150 | 200 |
| Amperes | 1 | 1 | 1 | 1 |
| Hours | 1.5 | 1.5 | 1.5 | 1.5 |
| Sample Volume (cc) | 100 | 100 | 100 | 100 |
| Current Density ($A/in^2$) | 5.1 | 5.1 | 5.1 | 5.1 |
| Initial $Ag^+$ (cc $Ag_2S$) | 0.38 | 0.38 | 0.38 | 0.38 |
| Final $Ag^+$ (cc $Ag_2S$) | 0.19 | 0.21 | 0.27 | 0.30 |
| Removed gms Ag/A.hour | 0.13 | 0.11 | 0.07 | 0.05 |

From the above table can be seen that the rate of silver removal decreases with frequency.

EXAMPLE XXI

A frequency of 400 Hz was applied across two ¼ inch graphite electrodes for 1.5 hours to 100 cc of used ammonium and sodium thiosulfate fixer. The current density was 5.1 amperes per square inch and the initial silver concentration was 0.38 cc of $Ag_2S$ per 10 cc of fixer. The voltage which was applied was between 2.8 and 4.5 and the temperature of the fixer did not exceed 35° C. Based on visual observation, an estimated 1 cubic millimeter of silver oxide was formed in 5 to 10 minutes. However, the silver oxide adhered to the electrodes and tended to limit further reaction. In order to continue the reaction, the electrodes would have to be cleaned.

EXAMPLE XXII

The parameters are the same as for Example XXI except that a frequency of 600 Hz was used. Based on visual observation, about 1 cubic millimeter of AgO was formed in about 4½ hours. Again, the AgO adhered to the electrodes and would have to be removed mechanically.

EXAMPLE XXIII

All of the parameters are the same as in Examples XXI and XXII except that a frequency of 800 Hz was used. Based on visual observation, an estimated 1 cubic millimeter of AgO was formed in 18 hours. However, the solid AgO adhered to the electrodes and would have to be removed mechanically.

In the preceding parts of the specification and Examples, where used or spent fixer containing silver is mentioned, it will be appreciated that the solution also contains bromide ions which are equivalent to the amount of silver ions in solution before the latter are removed.

While preferred embodiments of the present invention have been disclosed, it will be appreciated that it is not limited thereto but may be otherwise embodied within the scope of the following claims.

What is claimed is:

1. A method of electrochemically removing silver in the form of AgO from a photographic fixer solution without destroying the utility of the solution comprising the steps of applying alternating current having a frequency of between about 0.5 Hz and 800 Hz and a density of between about 0.1 and 20 amperes per square inch across electrodes immersed in said solution to cause AgO to precipitate at the electrodes.

2. A method as set forth in claim 1 wherein said frequency is between about 10 Hz and 120 Hz.

3. A method as set forth in claim 2 wherein said current density is between about 1 and 10 amperes per square inch.

4. A method as set forth in claim 2 wherein said current density is between about 3 and 7.5 amperes per square inch.

5. A method as set forth in claim 1 wherein said frequency is about 60 Hz.

6. A method as set forth in claim 5 wherein said current density is between about 1 and 10 amperes per square inch.

7. A method as set forth in claim 5 wherein said current density is between about 3 and 7.5 amperes per square inch.

8. A method as set forth in claim 1 wherein said electrodes are selected from the group of graphite, noble metals, ruthenium oxide coated valve metals, or stainless steel alloys.

9. A method as set forth in claim 8 wherein said frequency is between about 10 Hz and 120 Hz and wherein said current density is between about 1 and 10 amperes per square inch.

10. A method as set forth in claim 8 wherein said frequency is about 60 Hz and wherein said current density is between about 3 and 7.5 amperes per square inch.

11. A method as set forth in claim 1 wherein said current density is between about 1 and 10 amperes per square inch.

12. A method as set forth in claim 1 wherein said current density is between about 3 and 7.5 amperes per square inch.

13. A method of removing silver in the form of AgO from a photographic fixer solution comprising the steps of placing electrodes into electrical contact with said solution and applying alternating current having a frequency of between about 0.5 Hz and 800 Hz across said electrodes.

14. A method as set forth in claim 13 wherein said electrodes are selected from the group of graphite, noble metals, ruthenium oxide coated valve metals, or stainless steel alloys.

15. A method as set forth in claim 13 wherein said frequency is between about 10 Hz and 120 Hz.

16. A method of converting a silver salt to AgO comprising the steps of dissolving the silver salt in a solution of sodium, potassium, or ammonium thiosulfate; placing electrodes in electrical contact with the solution; and applying alternating current having a frequency of between about 0.5 Hz and 800 Hz across said electrodes.

17. A method as set forth in claim 16 wherein said silver salt is selected from the group of silver chloride, sulphate, phosphate, and nitrate.

18. A method as set forth in claim 17 wherein said frequency is between about 10 Hz and 120 Hz.

19. A method as set forth in claim 18 wherein said current has a density of between about 0.1 and 20 amperes per square inch.

20. A method as set forth in claim 16 wherein said frequency is between 10 Hz and 120 Hz.

21. A method as set forth in claim 20 wherein said frequency is about 60 Hz.

22. A method for continuously processing photographic fixer solution to remove silver therefrom comprising the steps of:

providing a cell having mutually spaced electrodes therein and a source of alternating current coupled to said electrodes;

continuously supplying said solution to said cell to submerge a predetermined portion of said electrodes;

applying alternating current having a frequency of between 0.5 Hz and 800 Hz and a current density of at least 0.1 amperes per square inch across said electrodes;

continuously removing said processed solution from said cell whereby the solution in said cell to be processed will be maintained at a predetermined level, and collecting a precipitate of AgO from said cell.

23. The method of claim 22 wherein the current density is between 0.1 and 20 amperes per square inch.

24. The method of claim 23 wherein said frequency is between about 10 Hz and 120 Hz.

25. The method of claim 22 wherein said frequency is about 60 Hz.

26. The method of claim 22 wherein said current density is between about 1 and 10 amperes per square inch.

27. The method of claim 22 wherein said current density is between about 3 and 7.5 amperes per square inch.

28. A continuous method for converting a silver salt to AgO comprising the steps of dissolving the silver salt in a solution of sodium, potassium or ammonium thiosulfate; providing a cell having mutually spaced electrodes and a source of alternating current coupled to said electrodes; continuously supplying said solution to said cell to submerge a predetermined portion of said electrodes; applying alternating current having a frequency of between 0.5 Hz and 800 Hz and a current density of at least 0.1 ampere per square inch across said electrodes; continuously removing said solution from said cell whereby the solution in said cell will be maintained in a predetermined level, and collecting a precipitate of AgO from said cell.

29. The method of claim 28 wherein said current density is between 0.1 and 20 amperes per square inch.

30. The method of claim 28 wherein said frequency is maintained at between 10 Hz and 120 Hz.

31. The method of claim 28 wherein said frequency is maintained at about 60 Hz.

32. The method of claim 28 wherein the current density is maintained at between about 1 and 10 amperes per square inch.

33. The method of claim 28 wherein the current density is maintained at between about 3 and 7.5 amperes per square inch.

* * * * *

UNITED STATES PATENT AND TRADEMARK OFFICE

CERTIFICATE OF CORRECTION

PATENT NO. : 4,021,320

DATED : May 3, 1977

INVENTOR(S) : KARL MOEGLICH

It is certified that error appears in the above-identified patent and that said Letters Patent are hereby corrected as shown below:

Column 3, line 40, "reclaimation" should read --reclamation--.

Column 5, line 30, "the" should read --The--.

Column 5, line 41, "past" should read --most--.

Signed and Sealed this

*second* Day of *August 1977*

[SEAL]

*Attest:*

RUTH C. MASON
*Attesting Officer*

C. MARSHALL DANN
*Commissioner of Patents and Trademarks*